US006179057B1

(12) United States Patent
Fontana et al.

(10) Patent No.: US 6,179,057 B1
(45) Date of Patent: Jan. 30, 2001

(54) APPARATUS AND METHOD FOR KILLING OR SUPPRESSING A SUBSEA WELL

(75) Inventors: Peter Fontana, Houston; James W. Macfarlane, Katy; Roger W. Fincher, Conroe, all of TX (US)

(73) Assignee: Baker Hughes Incorporated, Houston, TX (US)

( * ) Notice: Under 35 U.S.C. 154(b), the term of this patent shall be extended for 0 days.

(21) Appl. No.: 09/353,175

(22) Filed: Jul. 14, 1999

Related U.S. Application Data

(60) Provisional application No. 60/095,170, filed on Aug. 3, 1998.

(51) Int. Cl.[7] ..... E21B 7/12; E21B 7/00; E21B 34/04

(52) U.S. Cl. ..... 166/363; 166/90.1; 166/364; 166/368; 175/7

(58) Field of Search ..... 166/364, 363, 166/90.1, 365, 368; 175/7

(56) References Cited

U.S. PATENT DOCUMENTS

| | | | | |
|---|---|---|---|---|
| 3,552,502 | | 1/1971 | Wilson, Sr. | 175/25 |
| 3,743,013 | * | 7/1973 | Harbonn | 166/0.5 |
| 4,046,191 | * | 9/1977 | Neath | 166/0.5 |
| 4,193,455 | * | 3/1980 | Steddum et al. | 166/359 |
| 4,214,628 | * | 7/1980 | Botts | 166/75 R |
| 4,427,073 | * | 1/1984 | Sykora | 166/364 |
| 4,478,287 | * | 10/1984 | Hynes et al. | 166/341 |
| 4,495,999 | * | 1/1985 | Sykora | 166/364 |
| 4,630,680 | * | 12/1986 | Elkins | 166/34.2 |
| 4,880,060 | | 11/1989 | Schwendemann et al. | 166/366 |
| 5,188,180 | * | 2/1993 | Jennings | 166/338 |
| 5,727,640 | * | 3/1998 | Gleditsch | 175/7 |

FOREIGN PATENT DOCUMENTS

| | | | | |
|---|---|---|---|---|
| 1118342 | * | 2/1982 | (CA) | 166/368 |
| 0009364 | * | 4/1980 | (EP) | 166/368 |
| 093003254 | * | 2/1993 | (WO) | 166/353 |

* cited by examiner

*Primary Examiner*—David Bagnell
*Assistant Examiner*—Alexandra K. Pechhold
(74) *Attorney, Agent, or Firm*—Madan, Mossman & Sriram, P.C.

(57) ABSTRACT

The present invention provides apparatus and method for killing or suppressing a subsea wellbore. The system includes a pressure intensifier adjacent the wellhead. The output of the pressure intensifier is coupled to a "kill" inlet at the wellhead equipment. Power is supplied from the surface to the pressure intensifier, which increases the pressure by a known multiple, usually 3 to 5, and supplies the high pressure fluid to the wellbore. A control unit at the surface controls the operation of the pressure intensifier in response to the predefined criteria or programmed instructions. One or more sensors provide measurements to the control unit of the wellbore conditions, which are used to determine the timing of activation of the pressure intensifier.

8 Claims, 1 Drawing Sheet

APPARATUS AND METHOD FOR KILLING OR SUPPRESSING A SUBSEA WELL

REFERENCE TO CORRESPONDING APPLICATIONS

This application claims benefit of U.S. Provisional Application No. 60/095,170, filed on Aug. 3, 1998.

BACKGROUND OF THE INVENTION

1. Field of the Invention

This invention relates generally to subsea oilfield well operations and more particularly to apparatus and method for killing or suppressing a subsea well.

2. Description of the Related Art

In an emergency condition, such as to prevent a blow out or due to a catastrophic failure in the well, the well may need to be suppressed. In subsea applications, a fluid line, generally referred to as the "kill line," supplies pressurized fluid from a source at the rig to an inlet at the wellhead equipment at a pressure higher than the formation pressure. For deepwater wells, the water column or sea depth may be a few to several thousand feet. Due to such a long kill line, there is great pressure drop between the surface pumps supplying the pressurized fluid and the wellhead, making it difficult to provide the quantity of high pressure fluid to the wellhead to kill the well. Such long fluid lines require very large pumps at the surface, which are expensive and take large rig space.

The present invention provides apparatus and method for suppressing a well utilizing a fluid pressure intensifier deployed adjacent the wellhead equipment.

SUMMARY OF THE INVENTION

The present invention provides apparatus and method for suppressing a subsea well. The system includes a pressure intensifier adjacent the wellhead. The output of the pressure intensifier is coupled to a "kill" inlet at the wellhead equipment. Fluid under relatively low pressure is supplied from the surface to the pressure intensifier, which increases the pressure by a known multiple, usually 3 to 5, and supplies the high pressure fluid to the wellbore upon command to kill the well. A control unit at the surface controls the operation of the pressure intensifier in response to a predefined criteria or programmed instructions. One or more sensors provide measurements to the control unit of the wellbore conditions, which are used to determine the timing of activation of the pressure intensifier and the delivery of high pressure fluid to kill or suppress the well.

Examples of the more important features of the invention thus have been summarized rather broadly in order that detailed description thereof that follows may better be understood, and in order that the contributions to the art may be appreciated. There are, of course, additional features of the invention that will be described hereinafter and which will form the subject of the claims appended hereto.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals and wherein.

DESCRIPTION OF THE PREFERRED EMBODIMENT

Figure 1:
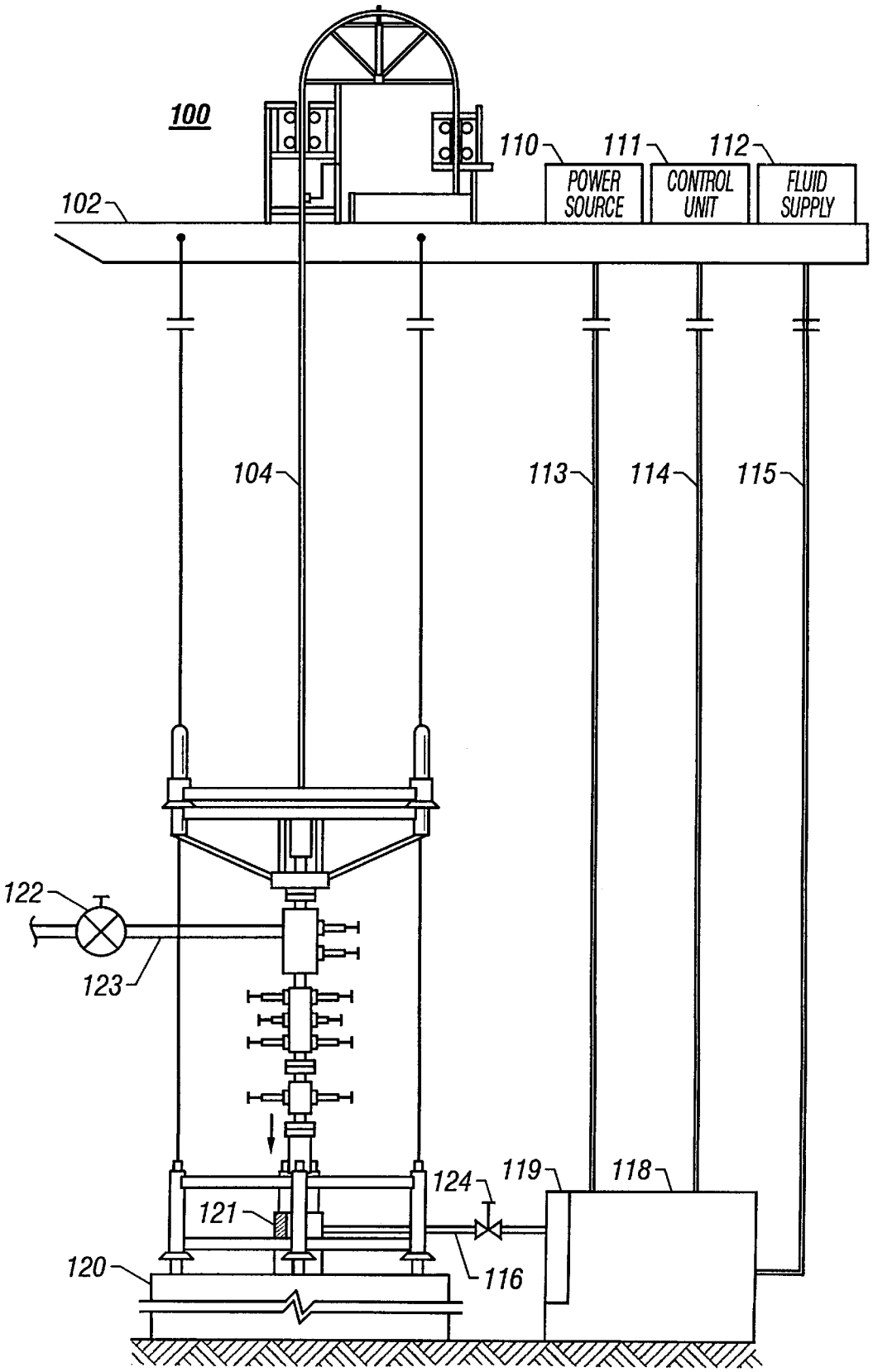
FIG. 1 shows a schematic diagram of a subsea well drilling operation with a pressure intensifier deployed adjacent the wellbore for killing or suppressing the well according to preferred embodiment.

The present invention provides an apparatus and method for killing or suppressing a subsea well.

The need to kill or suppress a well arises when the formation pressure exceeds the pressure of the return drilling fluid in the annulus of the wellbore. The formation fluid displaces the drilling fluid and is subject to pressurized discharge at the atmospheric well condition at the surface. This situation is particularly problematic when the formation fluid contains a significant portion of gas, which expands as it flows up toward the surface and as it is exposed to lower pressures. Upon expansion, the gas displaces further drilling fluid and increases the likelihood of a blow out. With deepwater riser-type drilling, the riser extends from the subsea wellhead to the surface and carries the return drilling fluid. As such, the riser can be used to control blow-out conditions, until high pressure fluid, such as heavy weight drilling fluid can be delivered to the wellbore. However, riserless drilling is more difficult to control during a blow-out.

In riserless drilling operations, it is required that a separate line of fluid be run to the wellhead to perform these operations. Likewise, in drilling environments that utilize a riser, it sometimes becomes desirable to maintain a separate line for this activity.

FIG. 1 shows a drilling operation for subsea wells 100 which includes a surface work station 102. For the purposes of this invention, the work station 102 is defined to include any type of ship, vessel, platform, or other device utilized at sea level which is used to house drilling equipment and maintain proper positioning for the drilling operations. Also shown is a wellhead 120 and tubing 104 employed in the well to perform the major drilling functions. Those skilled in the art understand the numerous conventional devices and equipment required for the drilling operation and, therefore, only the major components directly related to the practice of this invention are identified here for clarity of understanding the present invention.

In the present invention, a suitable pressure intensifier 118 is properly housed to withstand deep sea submersion. The pressure intensifier in some respects corresponds to a motor and pump combination receiving fluid at a first and lower pressure and discharging it at a second and higher pressure, with the power to do so being provided to the intensifier motor to increase the fluid pressure. The pressure intensifier 118 is placed on the sea bed adjacent the wellhead 120. A high pressure kill line 116 is connected between the pressure intensifier 118 and the annulus of the wellbore at the wellhead 120.

Located at the surface work station 102 is a suitable power source 110, a control unit 111 and a fluid supply 112 all connected to the intensifier. The pressure intensifier 118 is connected to the power source 110 through a suitable power line 113, such as a hydraulic pressure line. The pressure intensifier 118 is connected to the control unit 111 through the control line 114 which may be either an electrical, fiber optic or hydraulic line depending on the control system utilized. The pressure intensifier 118 is also connected to the fluid supply 112 through the supply line 115 which is a relatively low pressure fluid line.

More particularly, the intensifier 118 may be provided with the appropriate motor so as to be operated by different forms of power, such as hydraulic, pneumatic or electrical power. Thus the power line 113 is a corresponding connector for the different forms of power. The power line and control line 114 are available to be carried on an umbilical line (not shown) or a fluid return line, such as line 123, from the wellhead to the surface work station 102. The fluid supply 112 provides fluid at a relatively low pressure to the pressure intensifier and includes a suitable pump and motor to maintain the pressure and flow rate of the fluid to the intensifier upon its operation.

In a situation which requires killing or suppressing of the well, the control unit 111 sends a signal activating the pressure intensifier 118. Low pressure fluid, around 5000 psi, is provided to the pressure intensifier 118 from the fluid supply 112 through the supply line 115. The power source 110 energizes the pressure intensifier 118 through power line 113. The work produced by the pressure intensifier is expended on the low pressure supply fluid delivered by the supply line 115. This creates a second and higher pressure fluid which is discharged into the high pressure kill line 116. In effect, the pressure of the supply fluid is multiplied by a predetermined factor in order to supply fluid with the proper pressure for the killing operation. For example, if the low pressure supply is 5000 psi and the required pressure for the killing operation is 15,000 psi, then the pressure intensifier will be controlled to supply a boost in pressure three times that of the supply fluid—or in this case 10,000 psi.

The second pressure of the kill fluid is chosen to be at a higher pressure than that of the formation fluid, so as to suppress the tendency of the formation fluid to flow toward the wellhead and thus onto the surface. In short, the higher pressure "kill" fluid blocks or stops flow of formation fluid from the well.

The pressure intensifier may be provided with an accumulator 119 for holding a supply of fluid at the second and higher pressure from the pressure intensifier. This enables high pressure "kill" fluid to be applied immediately upon command via controlled valve 124 to the well and provide time for the operation of the intensifier 118 to generate a continuing supply of "kill" fluid.

The control system for the intensifier includes a sensor 121 for sensing a parameter indicative of the production of formation fluids at the wellbore. The parameters of interest include the pressure of the return fluid from the wellbore during drilling operations and the flow rate of the return fluid from the wellbore relative to that of the flow rate of the drilling fluid into the wellbore during drilling operations. The pressure of the return fluid is directly indicative of that of the formation fluid. The difference in the flow rate of the return fluid over that of the drilling fluid indicates that formation fluid is entering the fluid circulation system.

The signal from the sensor 121 is provided to a controller associated with the control unit 111 to operate the intensifier and control delivery of the kill fluid via the valve 124 to the well. In addition, the control unit 111 may control a valve 122 in the return line 123 to limit the flow of fluid in the return line when the well is killed.

The subsea intensifier of this invention thus enables "kill" fluid to be delivered to a subsea well at the time, in the quantity and at the pressure necessary to effectively control the well so as to prevent blow-outs. Moreover, this invention enables this function to be performed without the need for large pumps, fluid supply or fluid connection lines from the surface.

The foregoing description is directed to particular embodiments of the present invention for the purpose of illustration and explanation. It will be apparent, however, to one skilled in the art that many modifications and changes to the embodiment set forth above are possible without departing from the spirit of the invention.

What is claimed:

1. A method of killing or suppressing a subsea wellbore using pressurized fluid from a pressure intensifier, comprising:

providing the pressure intensifier at the seabed adjacent the wellbore;

delivering fluid at a first and relatively low pressure from a source thereof at the surface to the pressure intensifier;

operating the intensifier to increase the pressure of the fluid to a second and higher pressure greater than a formation pressure in the wellbore; and applying the fluid at the second and higher pressure to the wellbore at the wellhead to kill or suppress the well and thus suppress the production of formation fluids from the wellbore.

2. The method of claim 1 further comprising sensing a parameter indicative of the production of formation fluid in the wellbore.

3. The method of claim 2 wherein the parameter of interest is one of a group consisting of the pressure of the return fluid from the wellbore during drilling operations and the flow rate of the return fluid from the wellbore relative to that of the flow rate of drilling fluid into the wellbore during drilling operations.

4. The method of claim 2 further comprising activating the pressure intensifier in response to sensing the parameter.

5. The method of claim 1 further comprising limiting the flow of the return fluid when killing or suppressing the well.

6. A subsea system for selectively suppressing the production of formation fluids from a wellbore, comprising:

a source of fluid at first and relatively low pressure at the surface of an offshore location;

a pressure intensifier at the seabed adjacent the wellbore for increasing the pressure of the fluid to a second and higher pressure greater than the formation pressure in the wellbore;

subsea fluid flow connections between the source of fluid and the pressure intensifier;

subsea fluid flow connections between the pressure intensifier and a wellhead for the wellbore; and a controller for operating the pressure intensifier to pressurize the fluid and for controlling the delivery of fluid at the second pressure to the wellbore to kill the well by suppressing the production of formation fluids from the wellbore.

7. A system as set forth in claim 6 further comprising a sensor for sensing a parameter indicative of the production of formation fluids at the wellbore.

8. A system as set forth in claim 6 further comprises a subsea accumulator for storing a quantity of fluid pressurized to the second pressure for delivery to the wellbore upon command.

* * * * *